United States Patent [19]

Houghton

[11] Patent Number: 4,815,624

[45] Date of Patent: Mar. 28, 1989

[54] CONTAINER FOR NUCLEAR FUEL ELEMENTS

[75] Inventor: Anthony T. Houghton, Warrington, England

[73] Assignee: British Nuclear Fuels PLC, Warrington, England

[21] Appl. No.: 942,723

[22] Filed: Dec. 17, 1986

[51] Int. Cl.[4] ..... B65D 1/24

[52] U.S. Cl. ..... 220/20; 220/4 R; 220/21; 376/272; 250/507.1

[58] Field of Search ..... 220/20, 21, 22, 4 R, 220/4 C, 4 D; 376/261, 272; 29/723; 250/506.1, 507.1

[56] References Cited

U.S. PATENT DOCUMENTS

| | | | |
|---|---|---|---|
| 3,456,829 | 7/1969 | Glassmeyer | 220/4 R |
| 4,143,276 | 3/1979 | Mollon | 376/272 |
| 4,177,385 | 12/1979 | Bevilacqua | 376/272 |
| 4,342,620 | 8/1982 | Vickrey | 250/507.1 |
| 4,695,424 | 9/1987 | Flynn | 376/272 |

FOREIGN PATENT DOCUMENTS

| | | |
|---|---|---|
| 0014422 | 1/1980 | European Pat. Off. . |
| 0080894 | 6/1983 | European Pat. Off. . |
| 0158849 | 3/1985 | European Pat. Off. . |
| 622903 | 4/1981 | Fed. Rep. of Germany . |
| 2943085 | 5/1981 | Fed. Rep. of Germany . |

*Primary Examiner*—Willis Little

*Attorney, Agent, or Firm*—William R. Hinds

[57] ABSTRACT

A container for nuclear fuel elements comprises an assembly of individual elongate compartments formed from releasably inter-engageable plates which are held together in a rigid assembly by spider members located at intervals along the length of the assembly. The assembly can include neutron absorbing material and can be encircled by bracing bands or straps.

17 Claims, 5 Drawing Sheets

CONTAINER FOR NUCLEAR FUEL ELEMENTS

The present invention concerns a container for the transport and storage of nuclear fuel elements.

FEATURES AND ASPECTS OF THE INVENTION

According to the present invention a container for the transport and storage of nuclear fuel elements comprises a plurality of substantially identical elongate individual compartments the walls of which are formed by elongate rectangular plates disposed at right angles to one another, the plates being of equal lengths and in sets of different widths with longitudinal edge portions of each plate cooperating with and releasably engaging a plate disposed normal thereto, and a plurality of spider members positioned between the compartments and disposed at intervals along and cooperating with the plates for releasably holding the plates in a rigid assembly. The plates include first and second sets of plates, the plates of the first set being equal in length and width and the plates of the second set being in pairs of different widths. The cooperating longitudinal edge portions of the plates are formed with rebates, and each plate of the second set is formed with pairs of aligned spaced apart slots arranged at a spacing equal to that of the rebates in the longitudinal side edges and cooperable for releasable engagement with rebated edge portions of plates disposed normal thereto. In the preferred arrangement, each spider member comprises a transverse flat bar having an upstanding central leg at one side of the bar.

Conveniently, the assembly is encircled by bracing bands or straps.

DESCRIPTION OF THE DRAWINGS

The invention will be described further, by way of example, with reference to the accompanying drawings; in which.

Description of the Preferred Embodiment

A container for the transport and storage of nuclear fuel elements comprises an elongate octagonal shaped body 1 forming a plurality of compartments 2 to accommodate fuel elements. The container is assembled from sets of elongate plates, the plates being held together by a plurality of spider members which are arranged at intervals along the length of the assembly.

Figure 1:
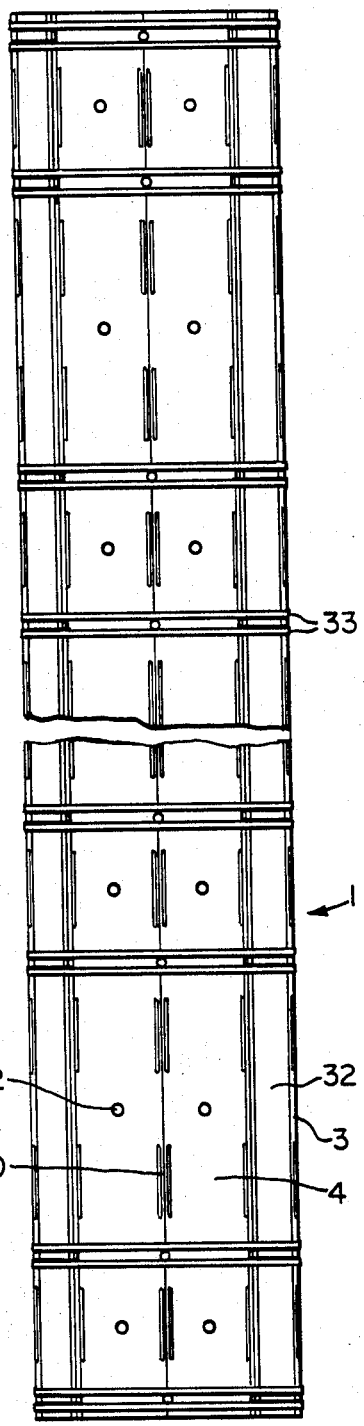
FIG. 1 is an elevation of an embodiment of a container for the transport and storage of nuclear fuel elements.
Figure 2:
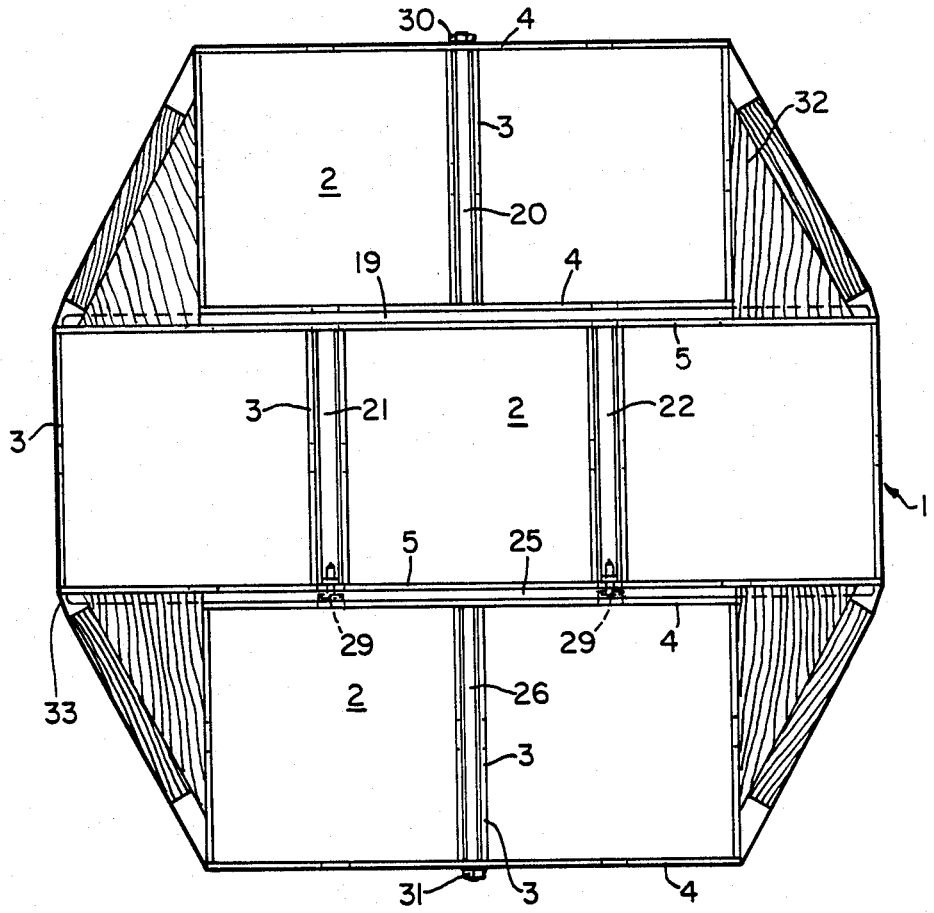
FIG. 2 is a plan view, not to scale, of the container in FIG. 1.

Two sets of plates are provided, and with reference to FIGS. 1 and 2, plates 3 of a first set are all equal in length and width and form a pair of opposing side walls of each compartment 2. Plates 4 and 5 of a second set are of the same length as the plates 3 in the first set but are in pairs of different widths with at least one pair of plates in each width. In FIG. 2 the plates 3 of the first set are shown vertical with the plates 4 and 5 of the second set normal thereto.

Figure 3:
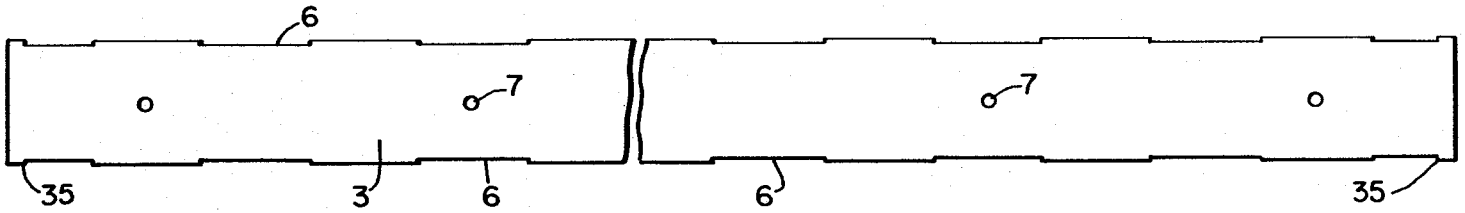
FIG. 3, 4 and 5 respectively depict different plates which co-operate to form walls of compartments in the container.

With reference to FIG. 3 the elongate plates 3 of the first set are formed with rebates 6 at each longitudinal side edge, the rebates being arranged at a regular pitch or spacing. A plurality of holes 7 are formed along the longitudinal axis of the plates, again at a regular pitch or spacing.

Figure 4:
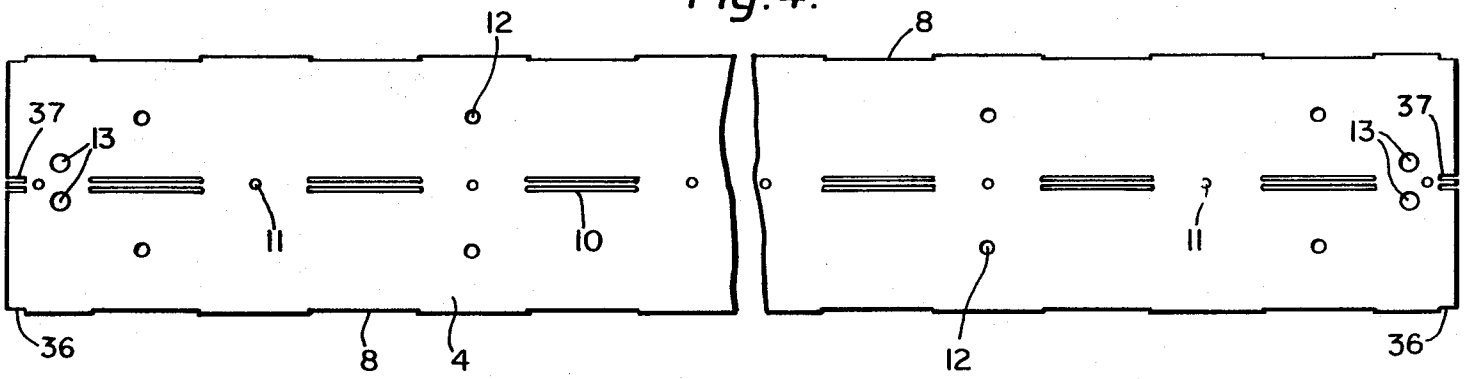
Figure 5:
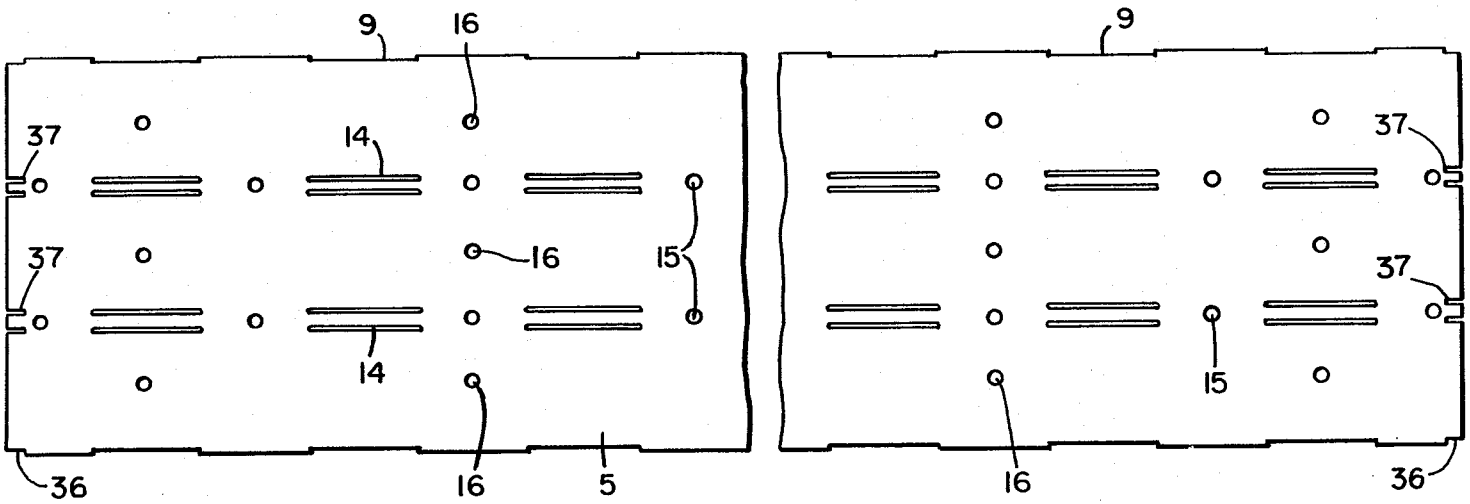

FIGS. 4 and 5 respectively show plates 4 and 5 of the second set, the plates being equal in length but having different widths. The length of the plates 4 and 5 is the same as the length of the plates 3 in the first set. As in the case of FIG. 3, the plates in FIGS. 4 and 5 are formed with rebates 8 and 9 respectively along each longitudinal side edge and at the same pitch. In FIG. 4, the plate 4 is provided with pairs of spaced apart slots 10 extending along the longitudinal axis of the plate at a pitch or spacing equal to that of the rebates in the side edges and with the slots of each pair disposed at opposite sides of the axis. A series of holes 11 are provided along the axis and between the slots 10. Further holes 12 are provided symmetrically at opposite sides of the axis and at regular intervals along the length of the plate 4. Finally, a pair of larger holes 13 are provided at each end of the plate 4.

The plate 5 in FIG. 5 is similar to that in FIG. 4 except that the plate is wider and formed with two rows of slots 14 disposed symmetrically at opposite sides of the longitudinal axis of the plate, the slots as before being in pairs. Holes 15 corresponding to the holes 11 in FIG. 4 are located between the ends of the pairs of slots. Further holes 16 corresponding to the holes 12 in FIG. 4 are arranged across the width of the plate and at regular intervals along the length of the plate 5. The holes 15 in the plate 5 are located at positions corresponding to the positions of the holes 11 in the plate 4. Likewise the holes 16 in the plate 5 are located at positions corresponding to the positions of the holes 12 in the plate 4.

Figure 6:
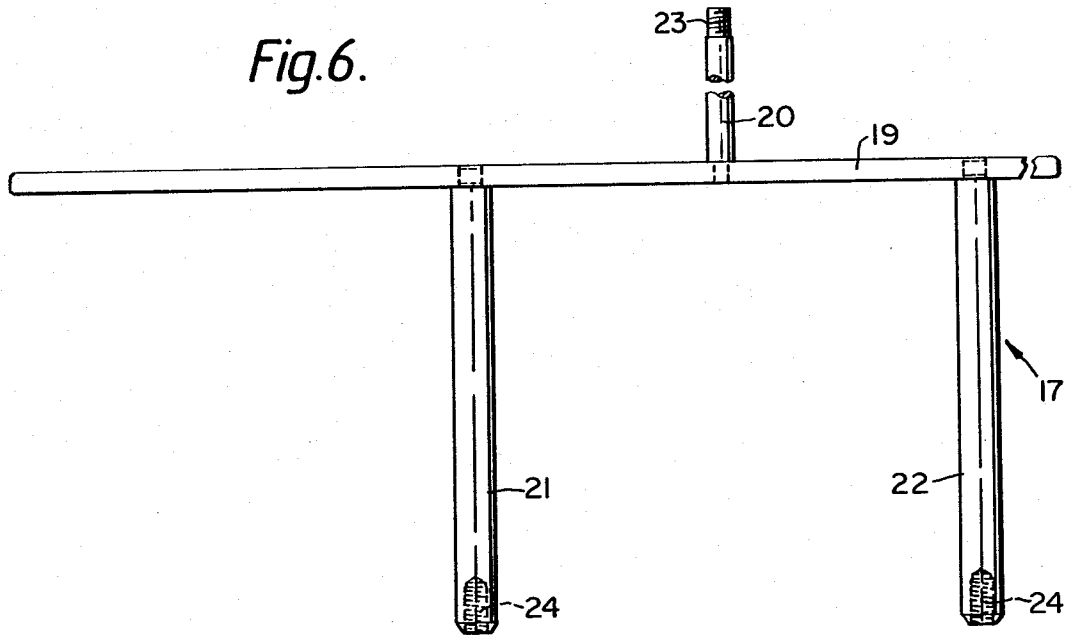
FIG. 6 and 7 respectively show further members of the container.
Figure 7:
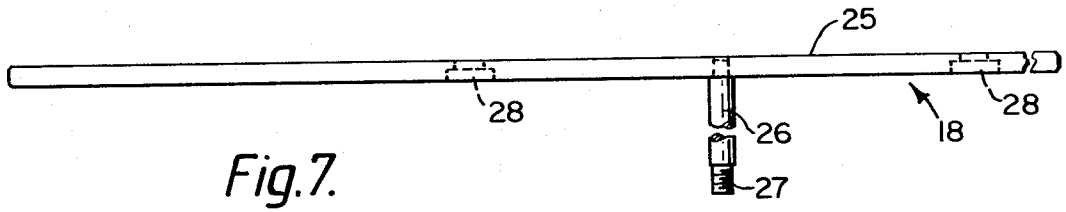

The assembly of FIGS. 1 and 2 employs two different spiders 17 and 18 as shown in FIGS. 6 and 7 respectively.

In FIG. 6 the spider 17 comprises a transverse flat bar 19 carrying an upstanding leg 20 positioned substantially at the mid-length of the bar 19 with two equal legs 21 and 22 extending from the opposite side of the bar 19 and at equal distances from the upstanding central leg 20. The free end of the central leg 20 is formed with a screw thread 23 and the free ends of the leg 21 and 22 are each drilled and tapped as denoted by reference numeral 24.

The spider 18 in FIG. 7 comprises a transverse flat bar 25 identical to the bar 19 of the spider 17. The bar 25 carries a single leg 26 at its mid-length, the free end of this leg having a screw-thread 27. Counter-sunk bores 28 are formed in the bar 25, one at each side of the leg 26, and at a spacing equal to that of the legs 21, 22 on the spider 17. The legs 20, 21, 22 and 26 can be round or square section.

Upon assembly, the rebated edges of the plates 3, which form interior walls of the compartments 2, engage in the slots in the plates 4 and 5. The rebated edges of the remaining plates 3 which are at the exterior of the assembly co-operate with the similarly rebated edges of the plates 4 and 5. Additionally, the plates 3 can be provided with tongues 35 at the ends thereof which engage is grooves 36 and slots 37 at the ends of the plates 4 and 5. Spiders 17 are positioned between the plates forming the upper and middle row of compartments 2 as viewed in FIG. 2 and at spaced intervals along the length of the plates. The threaded end 23 of leg 20 passes through hole 11 in the upper plate 4. Legs 21 and 22 pass through holes 15 in the upper plate 5 in FIG. 2.

Similarly, spiders 18 are positioned between the plates at the bottom of the assembly in FIG. 2. The bar 25 of the spider 18 is secured to the ends of the legs 21 and 22 of the spider 17 by screws 29 which are located in the counter-sunk bores 28 in the bar 25 and pass through holes 15 in the lower plate 5 to engage in the tapped bores 24 at the ends of the legs 21 and 22 of the spider 17. The threaded end 27 of the leg 26 extends between plates 3 and passes through hole 11 in the lower plate 4. A nut 30 engages the threaded end 23 of the leg 20 to retain the upper plate 4 in FIG. 2. Likewise a nut 31 engages the threaded end 27 of the leg 26.

The assembly is adapted to be housed in a flask or container with the fuel elements immersed in water. The holes 7, 12 and 16 in the respective plates permit circulation of the water. The holes 13 at the ends of the plates 4 are for lifting and lowering the assembly into and out of its flask or container.

The assembly can be completed by locating corner fillets 32, which are preferably of a neutron absorbing material, as indicated in FIG. 2. Finally the assembly can be secured in a compact array by means of banding straps 33 to encircle the periphery of the assembly, the straps being positioned adjacent each side of the spiders along the length of the assembly. The straps 33 are tensioned sufficiently to retain the corner fillets 32 in tight abutment against the plates 3 and 5.

The plates 3, 4 and 5 are conveniently formed from boronated stainless steel and the spiders can be formed from stainless steel. The construction is such that a rigid assembly is obtained without resort to welding with the additional advantage that the assembly can be readily reduced to its component parts if required.

It will be appreciated that the invention is not confined to the illustrated embodiment. The arrangement of plates and spiders can be extended to cater for assemblies having a different number and configuration of compartments to that shown in the drawings.

I claim:

1. A container for the transport and storage of nuclear fuel elements comprising a plurality of substantially identical elongate individual compartments the walls of which are formed by first and second sets of elongate rectangular plates disposed at right angles to one another, all of the plates being equal in length, the plates of the first set being equal in width and the plates of the second set being in pairs of different widths, rebates in the longitudinal edge portions of each plate forming rebated edges cooperable for releasable engagement with a plate disposed normal thereto, each plate of the second set having pairs of aligned spaced apart slots arranged at a spacing equal to that of the rebates in the longitudinal side edges and cooperable for releasable engagement with rebated edge portions of plates disposed normal thereto, and a plurality of spider members positioned between the compartments and disposed at intervals along and cooperating with the plates for releasably holding the plates in a rigid assembly.

2. A container according to claim 1 which the pairs of aligned slots extend along the longitudinal axis of the plate, the slots of each pair being disposed at opposite sides of the axis.

3. A container according to claim 2 including holes in the plates at positions intermediate adjacent aligned pairs of slots.

4. A container according to claim 1 in which the pairs of aligned slots are arranged in rows which are disposed symmetrically at opposite sides of the longitudinal axis of the plate.

5. A container according to claim 3 including holes in the plates at positions intermediate adjacent aligned pairs of slots.

6. A container according to claim 1 in which each spider member comprises a transverse flat bar having an upstanding central leg at one side of the bar.

7. A container according to claim 6 in which bores are formed in the bar equispaced one at each side of the central leg.

8. A container according to claim 6 in which the free end of the central leg is formed with a screw thread.

9. A container according to claim 6 in which two equal upstanding legs extend from the opposite side of the bar at equal distances from the central leg.

10. A container according to claim 9 in which the free ends of the two legs are each formed with a tapped socket.

11. A container according to claim 1 including a neutron absorber material within the assembly.

12. A container according to claim 1 including bracing straps to encircle and secure the assembly.

13. A container for the transport and storage of nuclear fuel elements comprising a plurality of substantially identical elongate individual compartments the walls of which are formed by elongate rectangular plates disposed at right angles to one another, the plates being of equal lengths and in sets of different widths with longitudinal edge portions of each plate cooperating with and releasably engaging a plate disposed normal thereto, and a plurality of spider members positioned between the compartments and disposed at intervals along and cooperating with the plates for releasably holding the plates in a rigid assembly, each spider member comprising a transverse flat bar having an upstanding central leg at one side of the bar.

14. A container according to claim 13 in which bores are formed in the bar equispaced one at each side of the central leg.

15. A container according to claim 13 in which the free end of the central leg is formed with a screw thread.

16. A container according to claim 13 in which two equal upstanding legs extend from the opposite side of the bar at equal distances from the central leg.

17. A container according to claim 16 in which the free ends of the two legs are each formed with a tapped socket.

* * * * *